US008356430B2

(12) United States Patent
Beers

(10) Patent No.: US 8,356,430 B2
(45) Date of Patent: Jan. 22, 2013

(54) ARTICLE OF FOOTWEAR INCORPORATING AN ILLUMINABLE FLUID-FILLED CHAMBER

(75) Inventor: Tiffany A. Beers, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 434 days.

(21) Appl. No.: 12/704,068

(22) Filed: Feb. 11, 2010

(65) Prior Publication Data

US 2011/0192053 A1 Aug. 11, 2011

(51) Int. Cl.
*A43B 23/00* (2006.01)
*A43B 21/28* (2006.01)

(52) U.S. Cl. ..... 36/137; 36/29; 362/103

(58) Field of Classification Search ..... 369/137, 369/103, 29; 362/103, 101, 84
See application file for complete search history.

(56) References Cited

U.S. PATENT DOCUMENTS

| | | | |
|---|---|---|---|
| 1,184,396 | A | 5/1916 | Trimble |
| 3,008,038 | A | 11/1961 | Dickens et al. |
| 3,070,907 | A | 1/1963 | Rocco |
| 3,893,247 | A | 7/1975 | Dana, III |
| 3,946,505 | A | 3/1976 | Dana, III |
| 4,130,951 | A | 12/1978 | Powell |
| 4,253,253 | A | 3/1981 | McCormick |
| 4,748,366 | A | 5/1988 | Taylor |
| 4,848,009 | A | 7/1989 | Rodgers |
| 5,033,212 | A | 7/1991 | Evanyk |
| 5,188,447 | A | 2/1993 | Chiang et al. |
| 5,303,131 | A | 4/1994 | Wu |
| 5,303,485 | A | 4/1994 | Goldston et al. |
| 5,329,432 | A | 7/1994 | Bland |
| 5,381,615 | A | 1/1995 | McMillan |
| 5,396,720 | A | 3/1995 | Hwang |
| 5,406,724 | A | 4/1995 | Lin |
| 5,408,764 | A | 4/1995 | Wut |
| 5,457,900 | A | 10/1995 | Roy |
| 5,461,188 | A | 10/1995 | Drago et al. |
| 5,483,759 | A | 1/1996 | Silverman |
| 5,490,338 | A | 2/1996 | Hwang et al. |
| 5,495,136 | A | 2/1996 | Chiang et al. |
| 5,546,681 | A | 8/1996 | Goldston et al. |
| 5,572,817 | A | 11/1996 | Chien |
| 5,599,088 | A | 2/1997 | Chien |
| 5,611,621 | A | 3/1997 | Chien |
| 5,649,755 | A | 7/1997 | Rapisarda |
| 5,704,705 | A | 1/1998 | Chien |
| 5,732,486 | A | 3/1998 | Rapisarda |
| 5,746,499 | A | 5/1998 | Ratcliffe et al. |
| 5,771,611 | A | 6/1998 | Chang |

(Continued)

FOREIGN PATENT DOCUMENTS

| | | | |
|---|---|---|---|
| EP | 0121026 | A1 | 10/1984 |

(Continued)

*Primary Examiner* — Marie Patterson
(74) *Attorney, Agent, or Firm* — Plumsea Law Group, LLC

(57) ABSTRACT

An article of footwear may have an upper and a sole structure secured to the upper. The sole structure includes a chamber and at least one illuminable element. The chamber is formed from an at least partially transparent polymer material that encloses a fluid, and a portion of an exterior surface of the chamber is exposed to form a portion of an exterior surface of the footwear. The illuminable element is located within the sole structure and adjacent to the exterior surface the chamber. Light from the illuminable element may pass out of the sole structure by passing through the chamber, thereby imparting the configuration of an illuminable fluid-filled chamber.

20 Claims, 17 Drawing Sheets

U.S. PATENT DOCUMENTS

| | | | | |
|---|---|---|---|---|
| 5,794,366 | A | 8/1998 | Chien | |
| 5,806,960 | A | 9/1998 | Chien | |
| 5,812,063 | A | 9/1998 | Weng et al. | |
| 5,813,148 | A | 9/1998 | Guerra | |
| 5,857,273 | A | 1/1999 | Rapisarda | |
| 5,860,727 | A | 1/1999 | Chien | |
| 5,865,523 | A | 2/1999 | Chien | |
| 5,866,987 | A | 2/1999 | Wut | |
| 5,869,930 | A | 2/1999 | Baumberg et al. | |
| 5,879,069 | A | 3/1999 | Chien | |
| 5,894,201 | A | 4/1999 | Wong | |
| 5,894,686 | A | 4/1999 | Parker et al. | |
| 5,909,088 | A | 6/1999 | Wut | |
| 5,930,921 | A | 8/1999 | Sorofman et al. | |
| 5,945,911 | A | 8/1999 | Healy et al. | |
| 5,947,580 | A | 9/1999 | Chien | |
| 5,955,957 | A | 9/1999 | Calabrese et al. | |
| 5,969,479 | A | 10/1999 | Wong | |
| 6,012,822 | A | 1/2000 | Robinson | |
| 6,017,128 | A | 1/2000 | Goldston et al. | |
| 6,030,089 | A | 2/2000 | Parker et al. | |
| 6,104,140 | A | 8/2000 | Wut et al. | |
| 6,112,437 | A | 9/2000 | Lovitt | |
| 6,164,794 | A | 12/2000 | Rodgers | |
| 6,280,045 | B1 | 8/2001 | Anteby et al. | |
| 6,457,261 | B1 | 10/2002 | Crary | |
| 6,619,812 | B2 | 9/2003 | Rapisarda | |
| 6,669,151 | B2 | 12/2003 | Mascadri | |
| 6,764,193 | B1 | 7/2004 | Wei | |
| 6,789,913 | B2 | 9/2004 | Wei | |
| 6,837,590 | B2 | 1/2005 | Marston | |
| 6,843,578 | B1 | 1/2005 | Cheung | |
| 6,991,342 | B2 | 1/2006 | Gonet | |
| 7,054,784 | B2 | 5/2006 | Flentov et al. | |
| 7,114,822 | B2 | 10/2006 | Guzman | |
| 7,147,337 | B1 | 12/2006 | Rapisarda | |
| 7,171,331 | B2 | 1/2007 | Vock et al. | |
| 7,178,929 | B2 | 2/2007 | Guzman | |
| 7,181,870 | B2 | 2/2007 | Guzman | |
| 7,270,616 | B1 | 9/2007 | Snyder | |
| 7,937,856 | B2 * | 5/2011 | Cook et al. | 36/137 |
| 2003/0070324 | A1 | 4/2003 | Nelson | |
| 2004/0103563 | A1 | 6/2004 | Linge | |
| 2004/0114353 | A1 * | 6/2004 | Romeo | 362/103 |
| 2004/0255490 | A1 | 12/2004 | Wan et al. | |
| 2005/0018417 | A1 | 1/2005 | Chien | |
| 2005/0018450 | A1 | 1/2005 | Chien | |
| 2005/0207138 | A1 | 9/2005 | Cheung | |
| 2005/0286244 | A1 | 12/2005 | Weng | |
| 2005/0286248 | A1 | 12/2005 | Weng | |
| 2006/0007668 | A1 | 1/2006 | Chien | |
| 2006/0007670 | A1 | 1/2006 | Chien | |
| 2006/0101674 | A1 | 5/2006 | Ungari | |
| 2006/0198121 | A1 | 9/2006 | Thorpe et al. | |
| 2006/0221596 | A1 | 10/2006 | Chang | |
| 2006/0262517 | A1 | 11/2006 | Doerer et al. | |
| 2007/0028486 | A1 | 2/2007 | Montanya et al. | |
| 2007/0041193 | A1 | 2/2007 | Wong et al. | |
| 2007/0147026 | A1 | 6/2007 | Tseng | |
| 2007/0201221 | A1 | 8/2007 | Cherdak et al. | |
| 2007/0211451 | A1 | 9/2007 | Chung | |
| 2007/0236915 | A1 | 10/2007 | Chen | |
| 2008/0019119 | A1 * | 1/2008 | Marston | 362/103 |
| 2009/0158622 | A1 | 6/2009 | Cook et al. | |
| 2011/0192053 | A1 * | 8/2011 | Beers | 36/103 |

FOREIGN PATENT DOCUMENTS

| | | | |
|---|---|---|---|
| EP | 0534560 | A1 | 3/1993 |
| FR | 2643794 | | 9/1990 |
| JP | 10225305 | A1 | 8/1998 |
| WO | 9415494 | A1 | 7/1994 |

* cited by examiner

ARTICLE OF FOOTWEAR INCORPORATING AN ILLUMINABLE FLUID-FILLED CHAMBER

BACKGROUND

Articles of footwear generally include two primary elements, an upper and a sole structure. The upper may be formed from a variety of material elements (e.g., textiles, polymer sheets, foam layers, leather, synthetic leather) that are stitched or bonded together to form a void for comfortably and securely receiving a foot. More particularly, the upper generally extends over the instep and toe areas of the foot, along the medial and lateral sides of the foot, under the foot, and around the heel area of the foot. In some articles of footwear, such as basketball shoes and boots, the upper may extend upward and around the ankle to provide support or protection for the ankle. Access to the void within the upper is generally provided by an ankle opening in a heel region of the footwear. A lacing system is often incorporated into the upper to adjust the fit of the upper, as well as permitting entry and removal of the foot from the void within the upper. In addition, the upper may include a tongue that extends under the lacing system to enhance adjustability and comfort of the footwear.

The sole structure is secured to a lower portion of the upper and is generally positioned between the foot and the ground. In many articles of footwear, including athletic footwear, the sole structure incorporates a sockliner, a midsole, and an outsole. The sockliner is a thin, compressible member located within the void (i.e., under the foot) to enhance footwear comfort. The midsole extends downward from the upper and forms a middle layer of the sole structure. In addition to attenuating ground reaction forces (i.e., providing cushioning for the foot), the midsole may limit foot motions or impart stability, for example. Although the midsole of athletic footwear may be primarily formed from a foamed polymer material, the midsole may include a variety of additional footwear elements that enhance the comfort or performance of the footwear, including plates, moderators, fluid-filled chambers, lasting elements, or motion control members. The outsole is secured to a lower surface of the midsole and forms a ground-contacting portion of the footwear. Additionally, the outsole may be formed from a durable and wear-resistant material that includes texturing to improve traction.

SUMMARY

An article of footwear is disclosed herein as having an upper and a sole structure secured to the upper. The sole structure includes a chamber and at least one illuminable element. The chamber is formed from an at least partially transparent polymer material that encloses a fluid, and a portion of an exterior surface of the chamber is exposed to form a portion of an exterior surface of the footwear. The illuminable element is located within the sole structure and adjacent to the exterior surface the chamber.

An article of footwear may also incorporate a sole structure with a chamber extending from (a) a forefoot region to a heel region of the footwear and (b) a medial side to a lateral side of the footwear. The chamber may have (a) an upper surface oriented to face the upper, (b) a lower surface positioned opposite the upper surface and oriented to face a ground-engaging surface of the sole structure, and (c) a peripheral surface extending between the upper surface and the lower surface. At least a portion of the peripheral surface may be exposed to an exterior of the footwear from the forefoot region to the heel region on both the medial side and the lateral side. The sole structure may also have at least one illuminable element embedded within the sole structure and in contact with the upper surface of the chamber, the illuminable element extending from the forefoot region to the heel region.

Additionally, an article of footwear may have a sole structure with a fluid-filled chamber formed from an at least partially transparent polymer material. The sole structure may also have an opaque material and at least one illuminable element. The chamber has an exterior surface, a first area of the exterior surface being exposed to an exterior of the footwear, and a second area of the exterior surface being located within the sole structure. The opaque material is secured to a portion of the second area, and the illuminable element is located between the opaque material and the second area. Furthermore, light from the illuminable element may be capable of passing (a) into the chamber through the first area and (b) out of the chamber through the second area.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
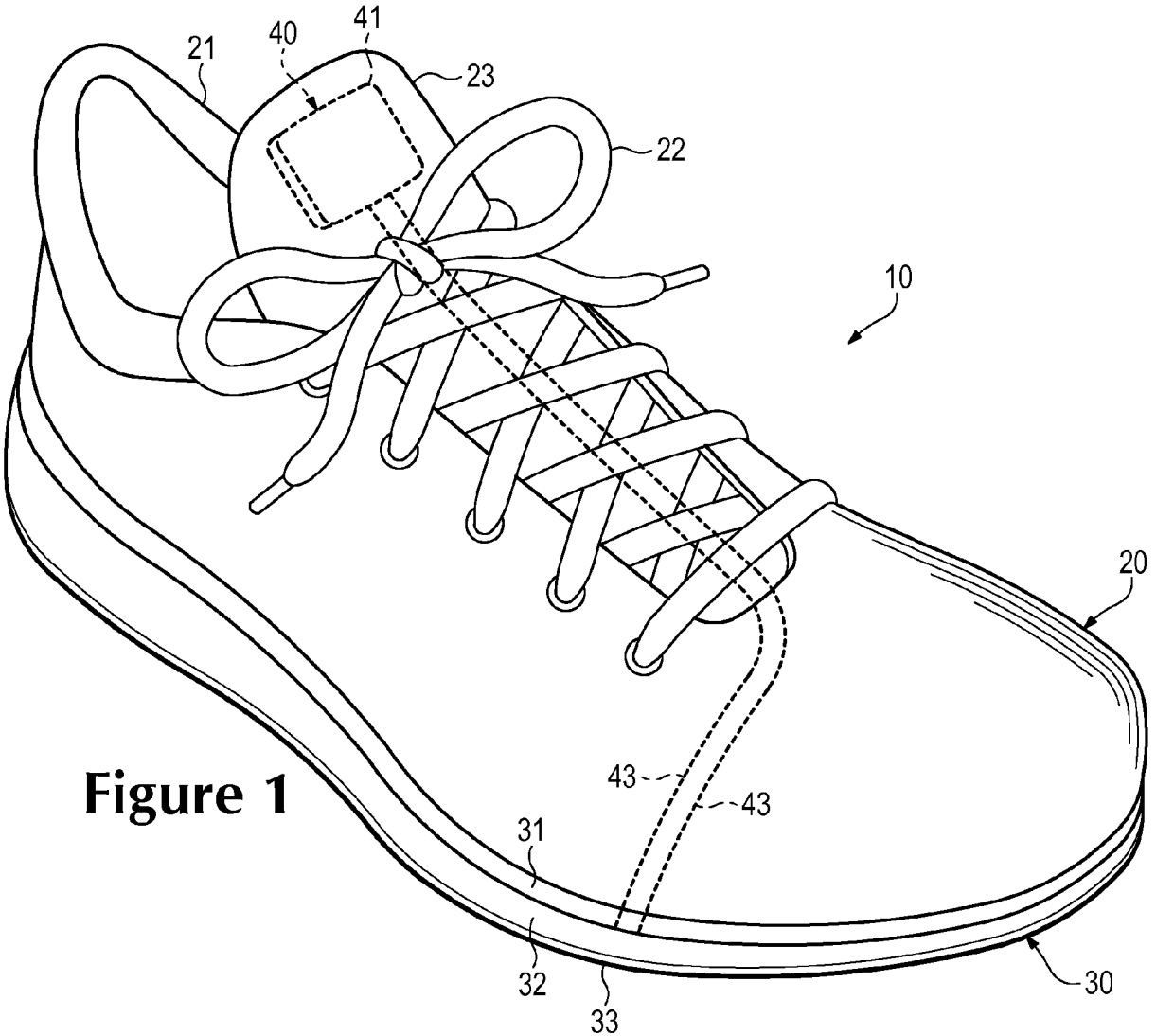
FIG. 1 is perspective view of an article of footwear.

The following discussion and accompanying figures disclose various configurations of an article of footwear 10 that incorporates illuminable elements. Concepts related to the illuminable elements are disclosed with reference to footwear that is suitable for running. The illuminable elements are not limited to footwear designed for running, however, and may be utilized with a wide range of athletic footwear styles, including basketball shoes, cross-training shoes, cycling shoes, football shoes, soccer shoes, tennis shoes, and walking shoes, for example. The illuminable elements may also be utilized with footwear styles that are generally considered to be non-athletic, including dress shoes, loafers, sandals, and boots. The concepts disclosed herein may, therefore, apply to a wide variety of footwear styles, in addition to the specific style discussed in the following material and depicted in the accompanying figures.

General Footwear Configuration

Footwear 10 is depicted in FIGS. 1-5B as including an upper 20, a sole structure 30, and an illumination circuit 40. In general, illumination circuit 40 is utilized to illuminate portions of footwear 10 (e.g., sole structure 30) and includes elements located within each of upper 20 and sole structure 30. In addition to imparting a unique aesthetic to footwear 10 and enhancing enjoyment of the wearer of footwear 10, illuminating portions of footwear 10 may increase the visibility of (a) the wearer, thereby making the wearer more visible to others in low light or darkened conditions and (b) obstacles or aspects of the ground (e.g., road, trail, running path), thereby making the obstacles more visible to the wearer. Illuminating portions of footwear 10 may also be utilized during product testing to enhance the visibility of areas of footwear 10 that are subjected to tensile, compression, bending, or twisting forces. That is, illuminating areas of footwear 10 may improve the degree to which the areas of footwear 10 are visible on high-speed film or other mediums that visually-capture performance data during biomechanical or other forms of testing.

Figure 3:
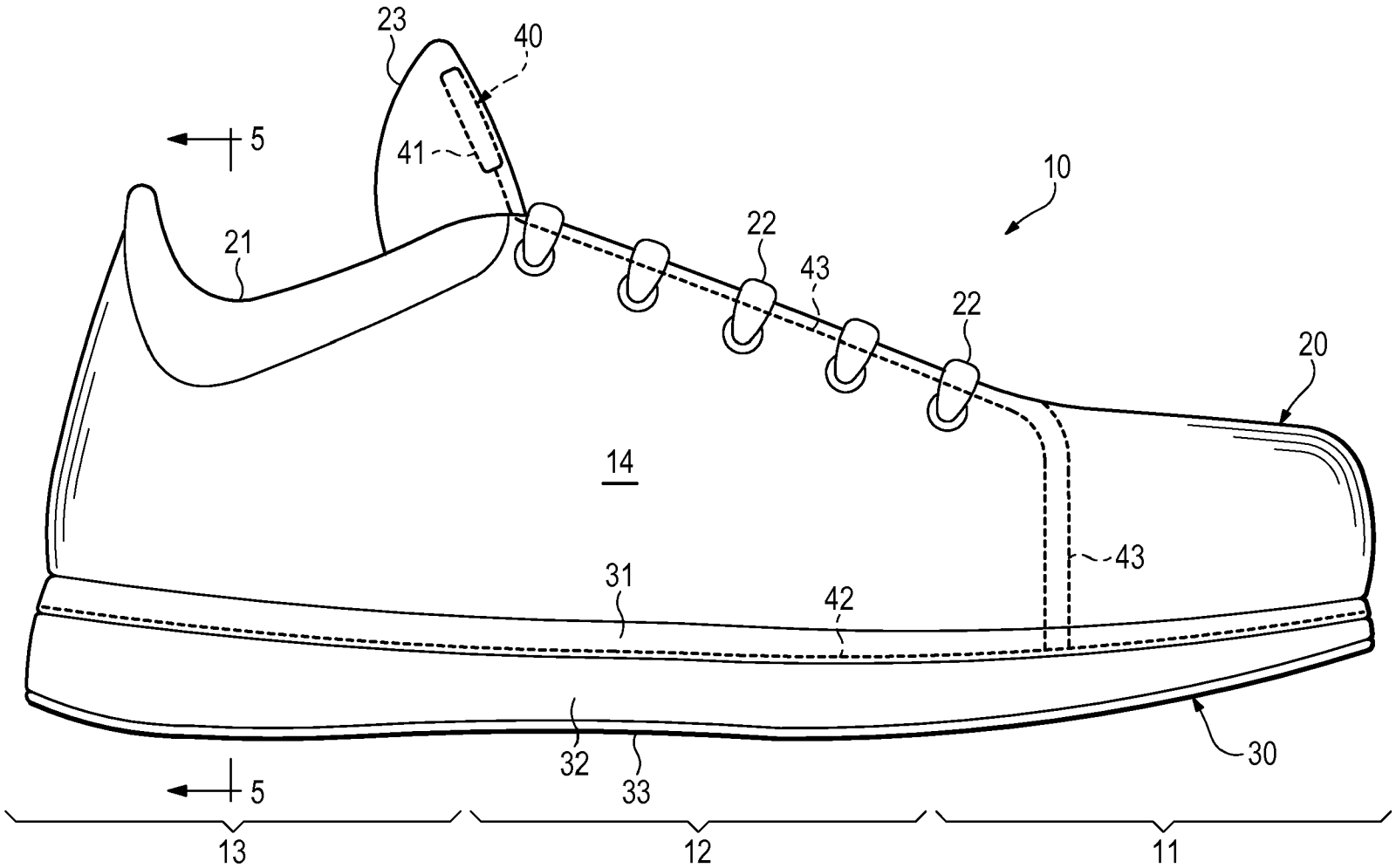
FIG. 3 is a lateral side elevational view of the article of footwear.
Figure 4:
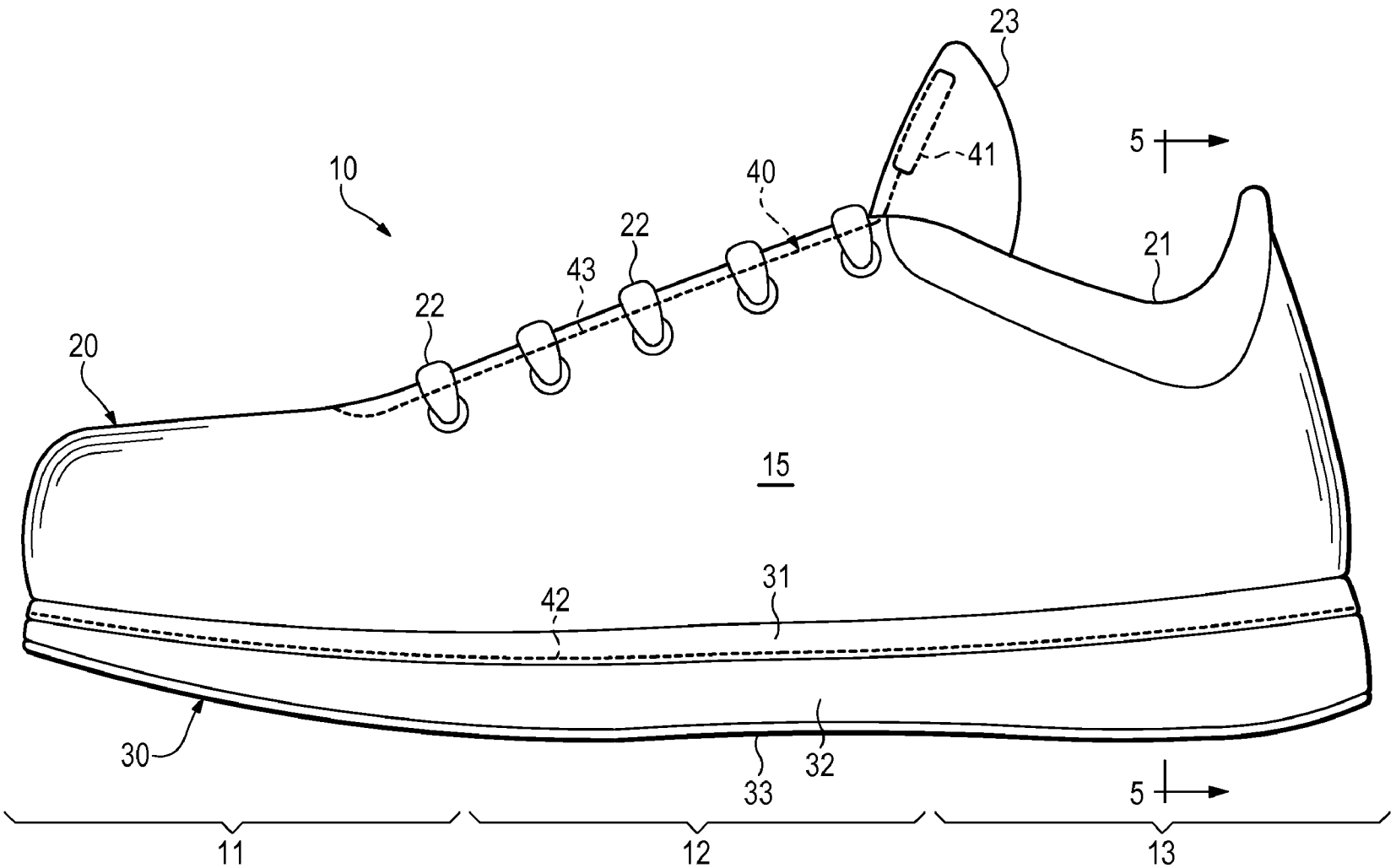
FIG. 4 is a medial side elevational view of the article of footwear.

For reference purposes, footwear 10 may be divided into three general regions: a forefoot region 11, a midfoot region 12, and a heel region 13, as shown in FIGS. 3 and 4. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with an arch area of the foot. Heel region 13 generally corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, illumination circuit 40, and individual elements thereof.

Upper 20 incorporates a plurality material elements (e.g., textiles, polymer sheets, foam layers, leather, synthetic leather) that are stitched or bonded together to form an interior void for securely and comfortably receiving a foot. The material elements may be selected to impart properties of durability, air-permeability, wear-resistance, flexibility, and comfort, for example, to specific areas of upper 20. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue 23 of upper 20 may extend between the interior void and lace 22. Although upper 20 provides an example of a suitable configuration for footwear 10, a variety of other upper configurations may be utilized with footwear 10.

Figure 5A:
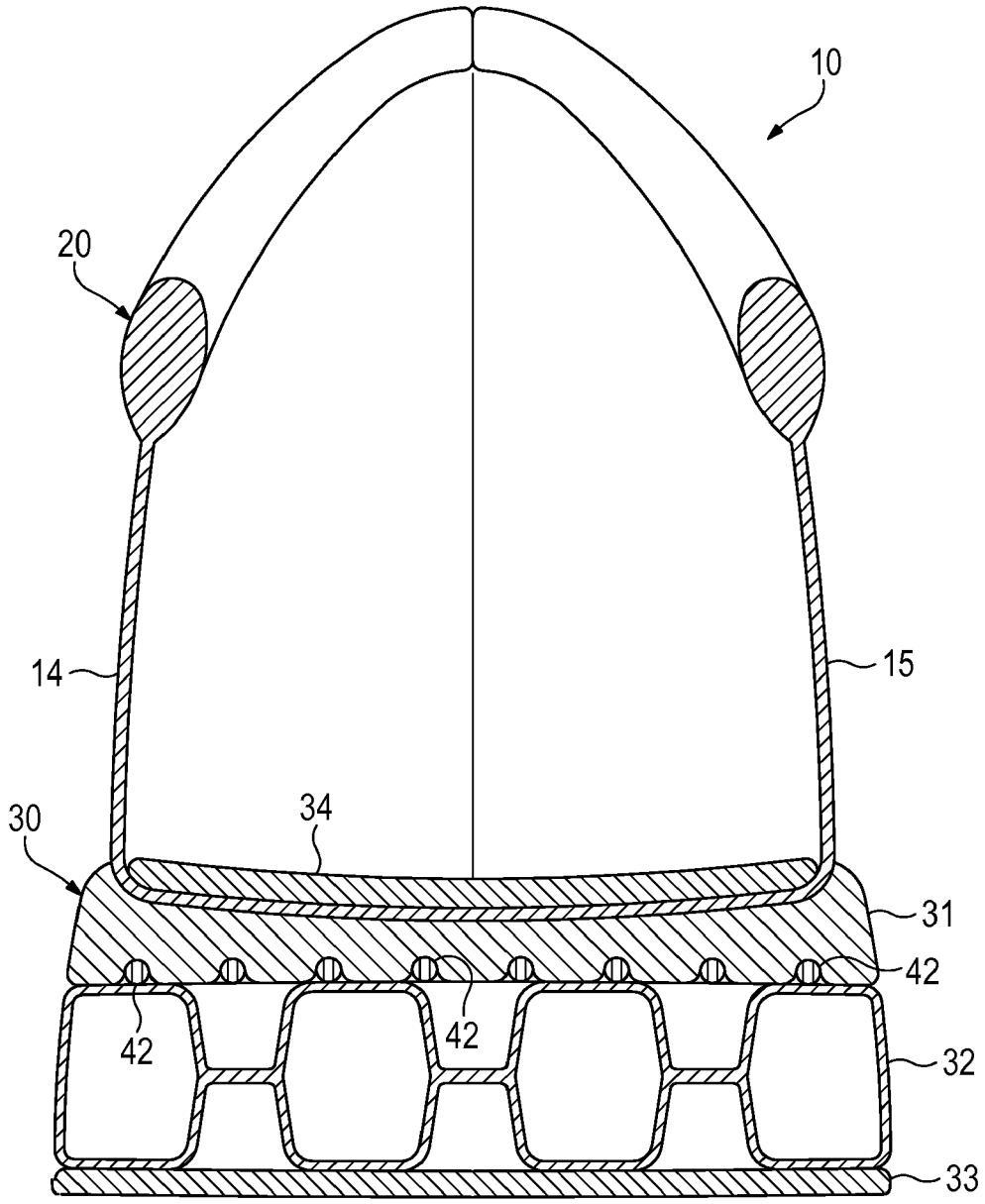
FIGS. 5A and 5B are a cross-sectional views of the article of footwear, as defined by section line 5 in each of FIGS. 3 and 4, showing the footwear in states of illumination.
Figure 5B:
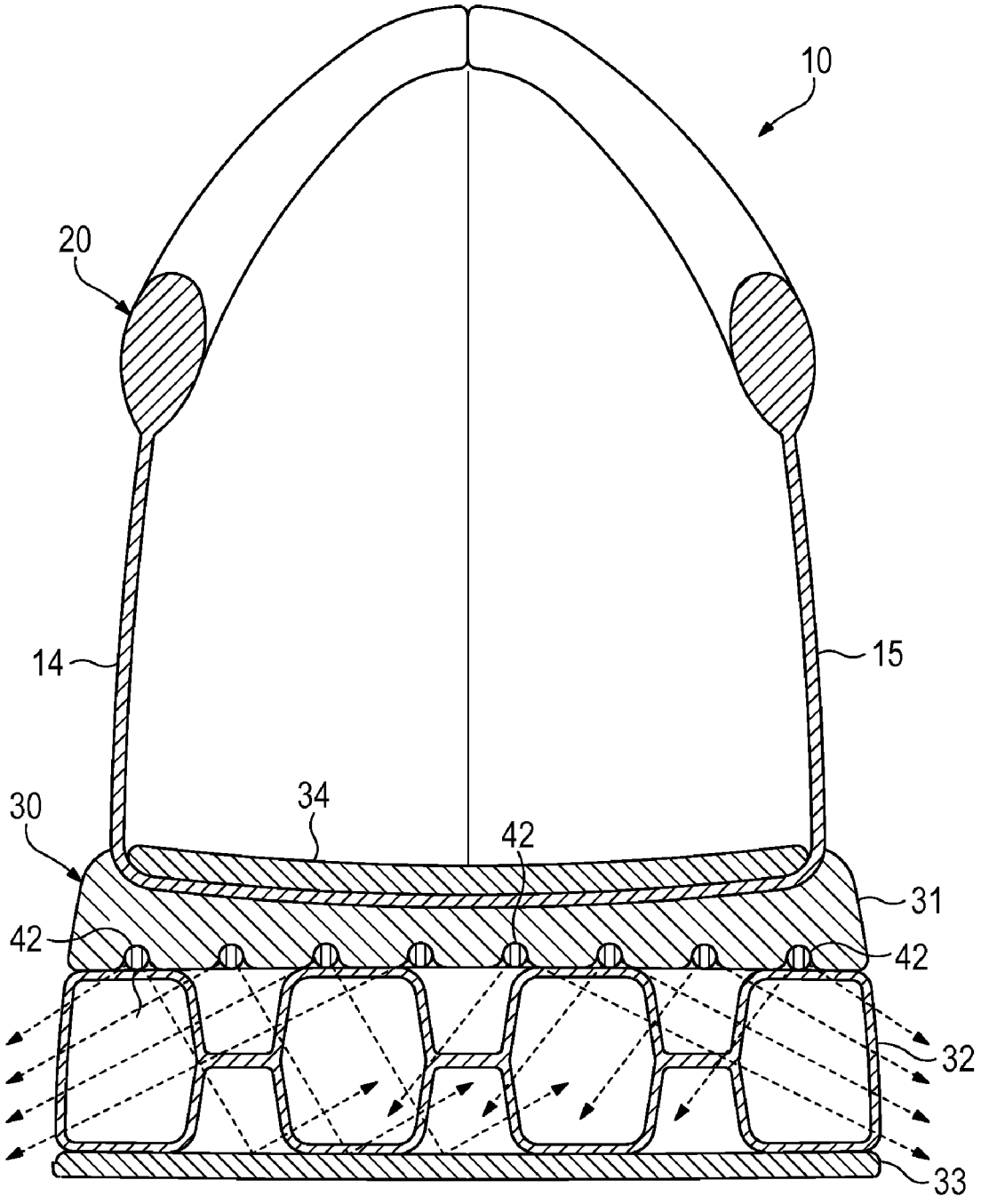

Sole structure 30 is secured to upper 20 and extends between upper 20 and the ground. In addition to attenuating ground reaction forces (i.e., imparting cushioning for the foot), sole structure 30 may provide traction, impart stability, and limit various foot motions, such as pronation. The primary elements of sole structure 30 are a midsole element 31, a chamber 32, and an outsole 33. In addition, sole structure 30 may include a variety of footwear elements that enhance the comfort or performance of footwear 10, including plates, moderators, lasting elements, or motion control members. Sole structure 30 may also incorporate a sockliner 34, as depicted in FIGS. 5A and 5B, that is located within a lower portion of the void in upper 20 and is positioned to contact a lower surface of the foot to enhance the comfort of footwear 10. Elements of illumination circuit 40 are also incorporated into sole structure 30. Although sole structure 30 provides an example of a suitable configuration for footwear 10, a variety of other sole structure configurations may be utilized in connection with footwear 10.

Midsole element 31 is secured to a lower area of upper 20 and may be formed from various polymer foam materials (e.g., polyurethane or ethylvinylacetate foam) that extend through each of regions 11-13 and between sides 14 and 15. In this configuration, midsole element 31 is positioned to extend under the foot and may be molded to conform with a general shape of the plantar surface of the foot. For example, midsole element 31 may form an indentation in heel region 13 that receives and securely-positions the heel of the foot. Midsole element 31 may also form a protrusion in midfoot region 12 and on medial side 15 to form an arch support. As discussed in greater detail below, the polymer foam material selected for midsole element 31 may be generally opaque. In addition to polymer foam materials, various non-foamed polymer materials may be utilized, including rubber, silicone, polyurethane, polyolefin, polyamide, polyurea, polyester, polyurethane and styrene-olefin-rubber block copolymer. Outsole 33 is secured to a lower area of chamber 32 and may be formed from a textured, durable, and wear-resistant material (e.g., rubber) that forms the ground-contacting portion of footwear 10.

Chamber 32 is secured to a lower area of midsole element 31 and has the general configuration of a bladder formed from an at least partially transparent polymer material that encloses a fluid (e.g., gas, liquid, gel). Although the fluid within chamber 32 may be pressurized, the fluid may also be at a substantially ambient pressure. When pressurized, bonds may be formed between opposite sides of chamber 32 to prevent expansion and retain an intended shape of chamber 32. As incorporated into sole structure 30, chamber 32 has a shape that fits within a perimeter of sole structure 30 and extends through each of regions 11-13 and between sides 14 and 15. When the foot is located within upper 20, therefore, chamber 32 extends under substantially all of the foot. Although an upper surface of chamber 32 is positioned adjacent and secured to midsole element 31 and a lower surface of chamber 32 is positioned adjacent and secured to outsole 33, a sidewall or peripheral surface of chamber 32 is exposed to an exterior of footwear 10 from forefoot region 11 to heel region 13 on both lateral side 14 and medial side 15. As examples, chamber 32 may incorporate various features or exhibit the general configuration of fluid-filled chambers disclosed in U.S. Pat. No. 7,556,846 to Dojan, et al.; U.S. Patent Application Publication 2008/0276490 to Holt, et al.; and U.S. Patent Application Publication 2009/0151196 to Schindler, et al.

Illumination Circuit

Figure 6:
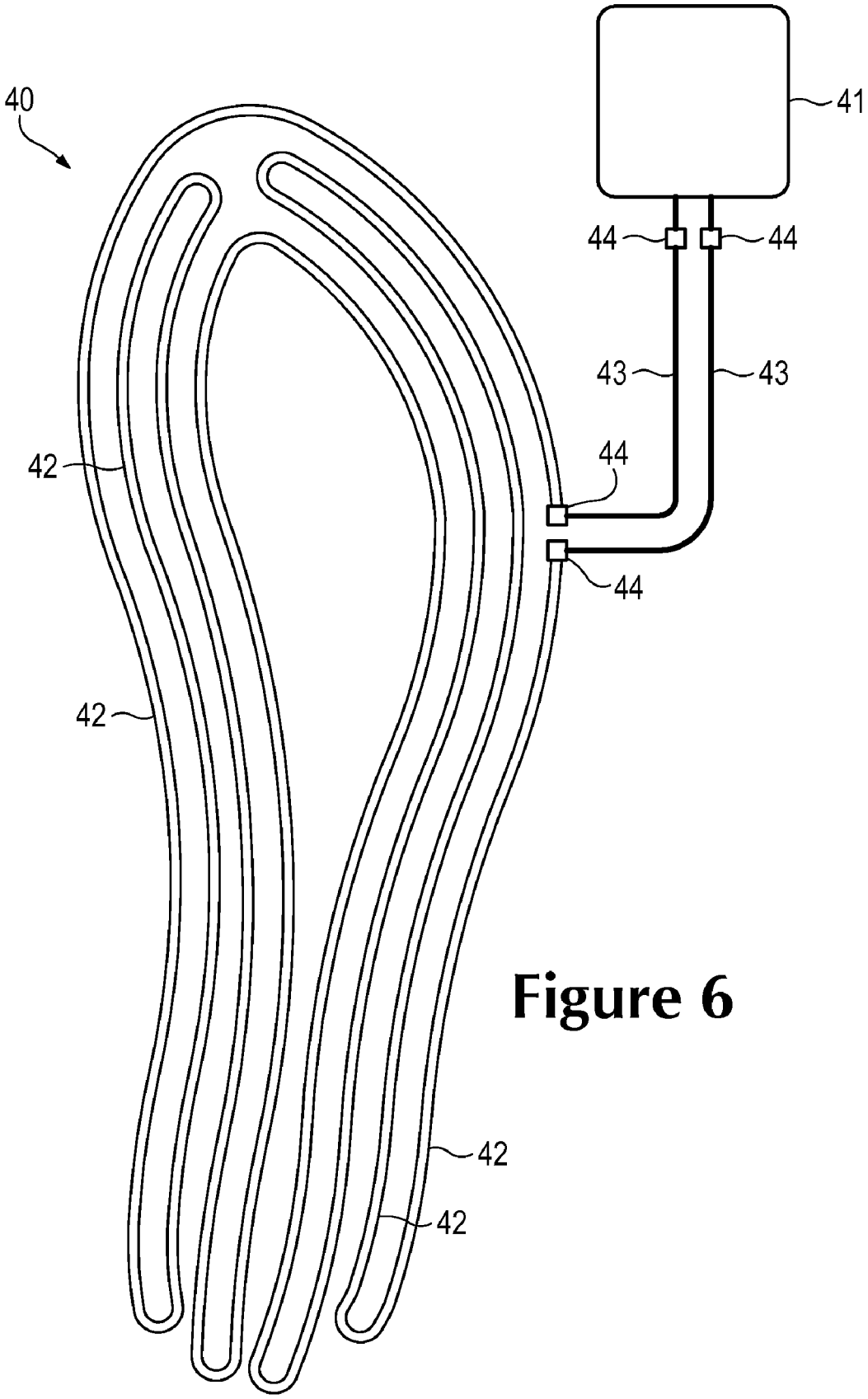
FIG. 6 is a schematic diagram of an illumination circuit of the article of footwear.

Illumination circuit 40 is depicted in FIG. 6 and includes a power source 41, an illuminable element 42, lead wires 43, and various connectors 44. In general, power source 41 delivers current and voltage to illuminable element 42 through the various lead wires 43 and connectors 44, thereby inducing illuminable element 42 to illuminate or otherwise emit light.

Figure 2:
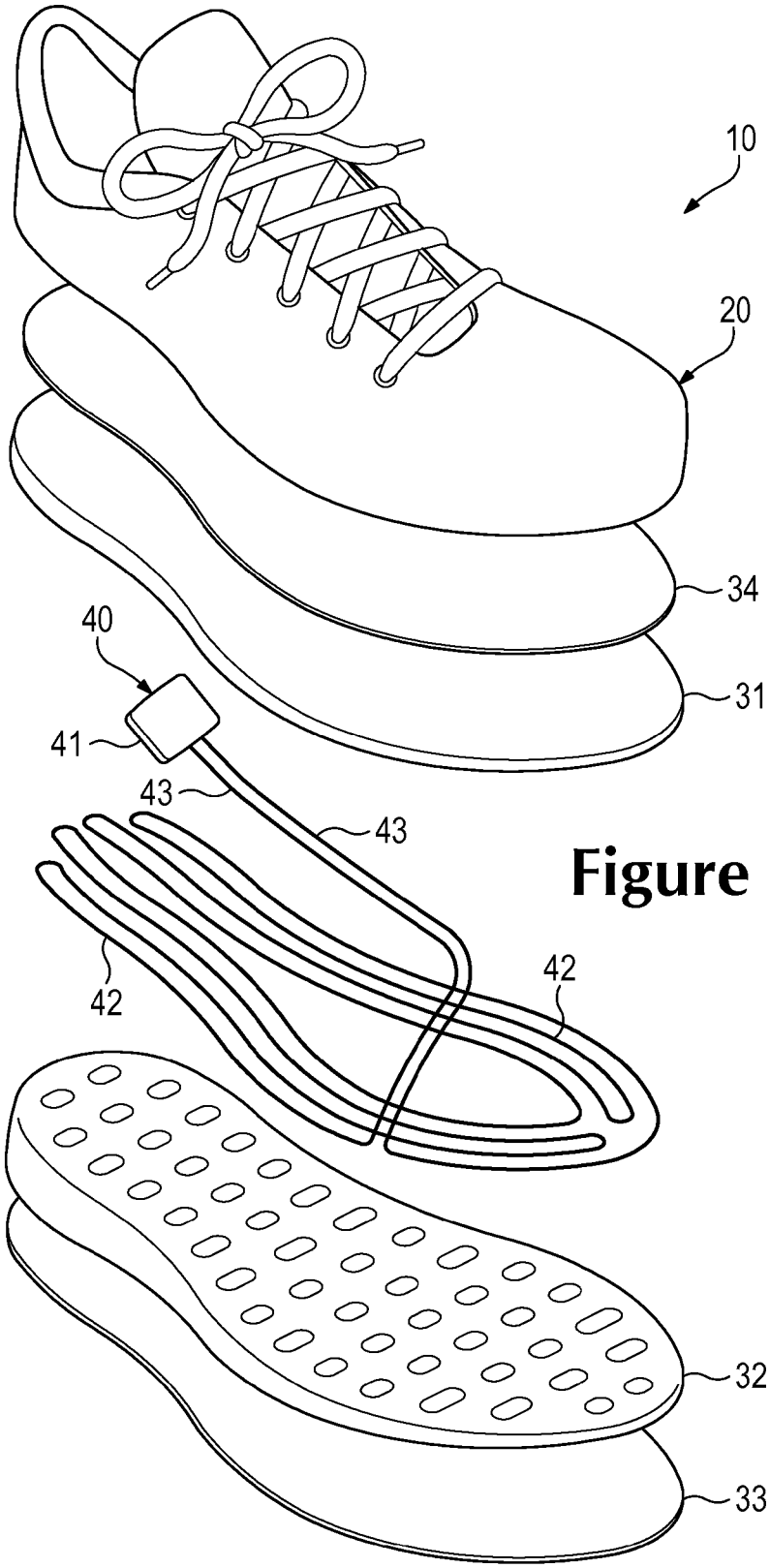
FIG. 2 is an exploded perspective view of the article of footwear.

Referring to FIGS. 2, 5A, and 5B, illuminable element 42 is incorporated into sole structure 30 between midsole element 31 and an exterior surface of chamber 32 and has a configuration of an electroluminescent wire (i.e., EL wire). Whereas FIG. 5A depicts a configuration wherein illuminable element 42 is in an unilluminated state, FIG. 5B depicts a configuration wherein illuminable element 42 is in an illuminated state. In the illuminated state, light emitted from illuminable element 42 passes through the at least partially transparent polymer material forming chamber 32 and exits footwear 10 through portions of chamber 32 that are exposed to an exterior of footwear 10. More particularly, the light emitted from illuminable element 42 (a) passes through the upper surface of chamber 32, which is adjacent to midsole element 31 and oriented to face upper 20, (b) enters a central void within chamber 31, which encloses the fluid, and (c) passes through the peripheral surface of chamber 32, which is exposed to an exterior of footwear 10 from forefoot region 11 to heel region 13 on both lateral side 14 and medial side 15. Additionally, the light emitted from illuminable element 42 may either reflect off of the lower surface of chamber 32, which is positioned opposite the upper surface and oriented to face a ground-engaging surface of the sole structure (i.e., outsole 33), or may pass through the lower surface. Given that midsole element 31 and outsole 33 are generally formed from opaque materials, the light emitted from illuminable element 42 exits footwear 10 only through the peripheral surface of chamber 32 and is seen as illuminating chamber 32.

Illuminable element 42 has the configuration of an electroluminescent wire, but may also be one or more light emitting diodes or an electroluminescent panel. Electroluminescent wire has a concentric series of layers that include: (a) a central conductive wire, such as copper wire, (b) an electroluminescent phosphor coating that surrounds the conductive wire, (c) a relatively fine conductive wire that wraps around the phosphor coating, and (d) an exterior polymer sheath, which is often formed as two layers of polyvinyl chloride, one of which may be colored. In operation, power source 41 delivers alternating current to illuminable element 42 through the various lead wires 43 and connectors 44. The alternating current passes through the central conductive wire and the relatively fine conductive wire, which produces an alternating electric field that induces the phosphor coating to glow or otherwise emit light. Although the frequency of the alternating electric field has an effect upon the wavelength of the light emitted from the phosphor coating, coloring in the polymer sheath imparts specific colors to the light that is emitted from illuminable element 42 and passes through chamber 32.

Power source 41 is depicted as being incorporated into upper 20, particularly tongue 23. In general, power source 41 may be any oscillating electric potential source, including an alternating current source, a direct current to alternating current converter output (i.e., the output of a battery and an inverter), or an electric oscillator (i.e., a sine wave generator, a square wave generator, or a tuned LC oscillator), for example. As a more specific example, power source 41 may include (a) a rechargeable polymer lithium-ion battery having an output of 3.7 volts and 300 milliampere hours and (b) an inverter providing an output of 264-330 volts peak-to-peak at a frequency of 425-525 hertz. Depending upon various factors, however, the battery and inverter specification may vary significantly. For example, the desired (a) length of the electroluminescent wire forming illuminable element 42, (b) intensity of the light output of illuminable element 42, and (c) time during which illuminable element 42 is to remain illuminated may all affect specifications for the battery and inverter utilized in power source 41. Although power source 41 is depicted as being a single component that includes the battery and inverter, power source 41 may also be a separate battery and inverter within illumination circuit 40. Additionally, power source 41 may include (a) a switch that permits the wearer to selectively emit light or vary the intensity of the light output and (b) a connector for recharging the battery. Accordingly, power source 41 may have a variety of configurations that are sufficient to illuminate illuminable element 42.

Lead wires 43 have the configuration of any electrically-conductive material, such as insulated copper wire, and are electrically-coupled to power source 41 with a pair of connectors 44. Given that power source 41 is located in an upper area of tongue 23, lead wires 43 extend along the length of tongue 23, pass through lateral side 14 of upper 20, and are electrically-coupled to ends of illuminable element 42 with another pair of connectors 44. Although lead wires 43 are depicted as passing through lateral side 14, lead wires 43 may also pass through medial side 15 or each of lead wires 43 may pass through one of sides 14 and 15. Moreover, connectors 44 may have a variety of configurations that are suitable for joining electrical components, and lead wires 43 may be formed to join with power source 41 and illuminable element 42 without connectors (e.g., with soldered connections) in some configurations of footwear 10.

Based upon the above discussion, chamber 32 may be formed from an at least partially transparent polymer material and midsole element 31 may be formed from an opaque material. One area of the exterior surface of chamber 32 is exposed to an exterior of the footwear, and another area of the exterior surface is located within sole structure 30 and secured to midsole element 31. Moreover, illuminable element 42 is located between the opaque material of midsole element 31 and chamber 32. In this configuration, light from the illuminable element is capable of passing (a) into the chamber through the area covered by midsole element 31 and (b) out of the chamber through the exposed area. In this configuration, light from illuminable element 42 may pass out of sole structure 30 by passing through chamber 32, thereby imparting the property of illuminability to chamber 32.

Further Footwear Configurations

Figure 7A:
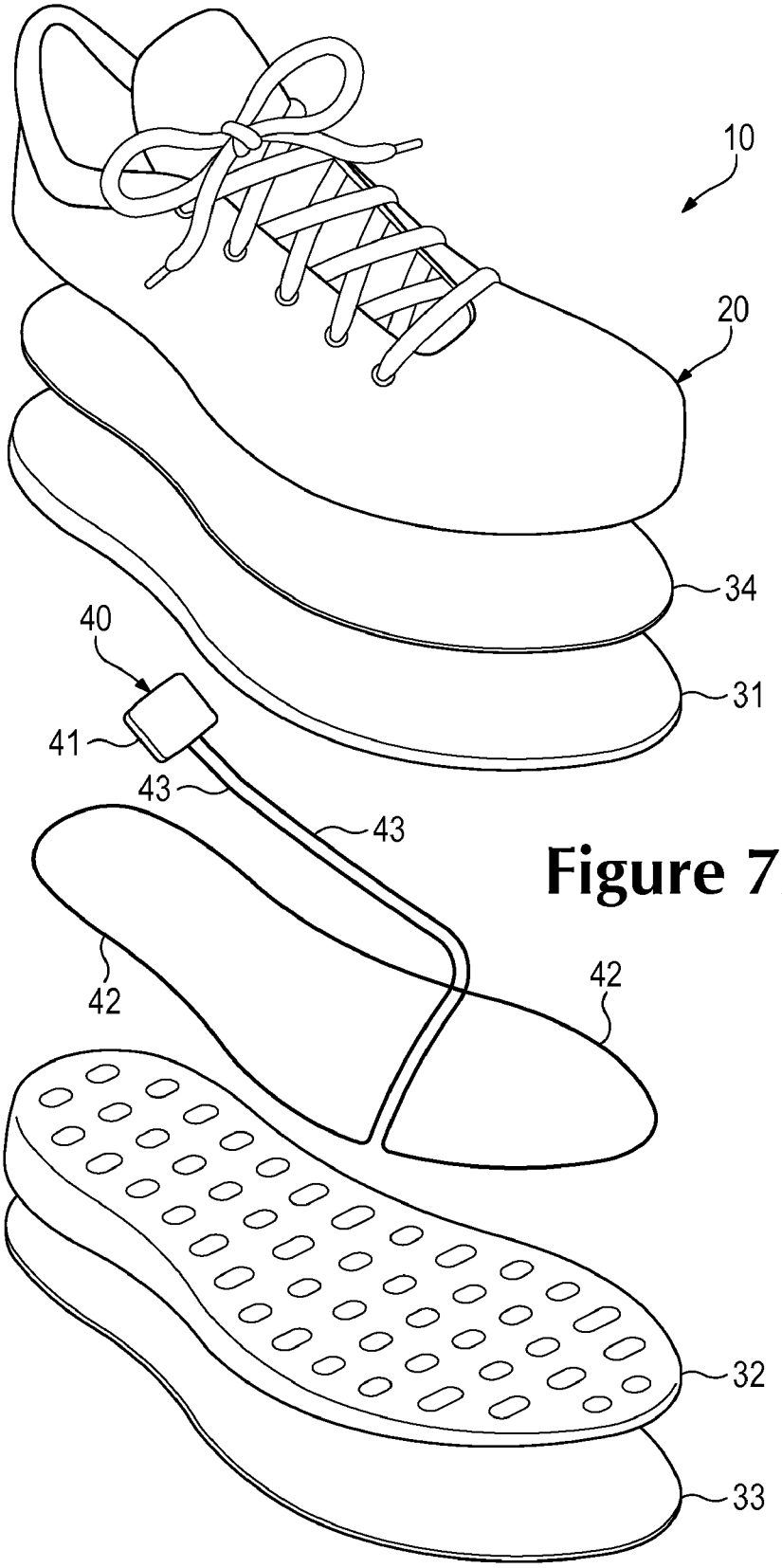
FIGS. 7A-7F are exploded perspective corresponding with FIG. 2 and depicting further configurations of the article of footwear.
Figure 7B:
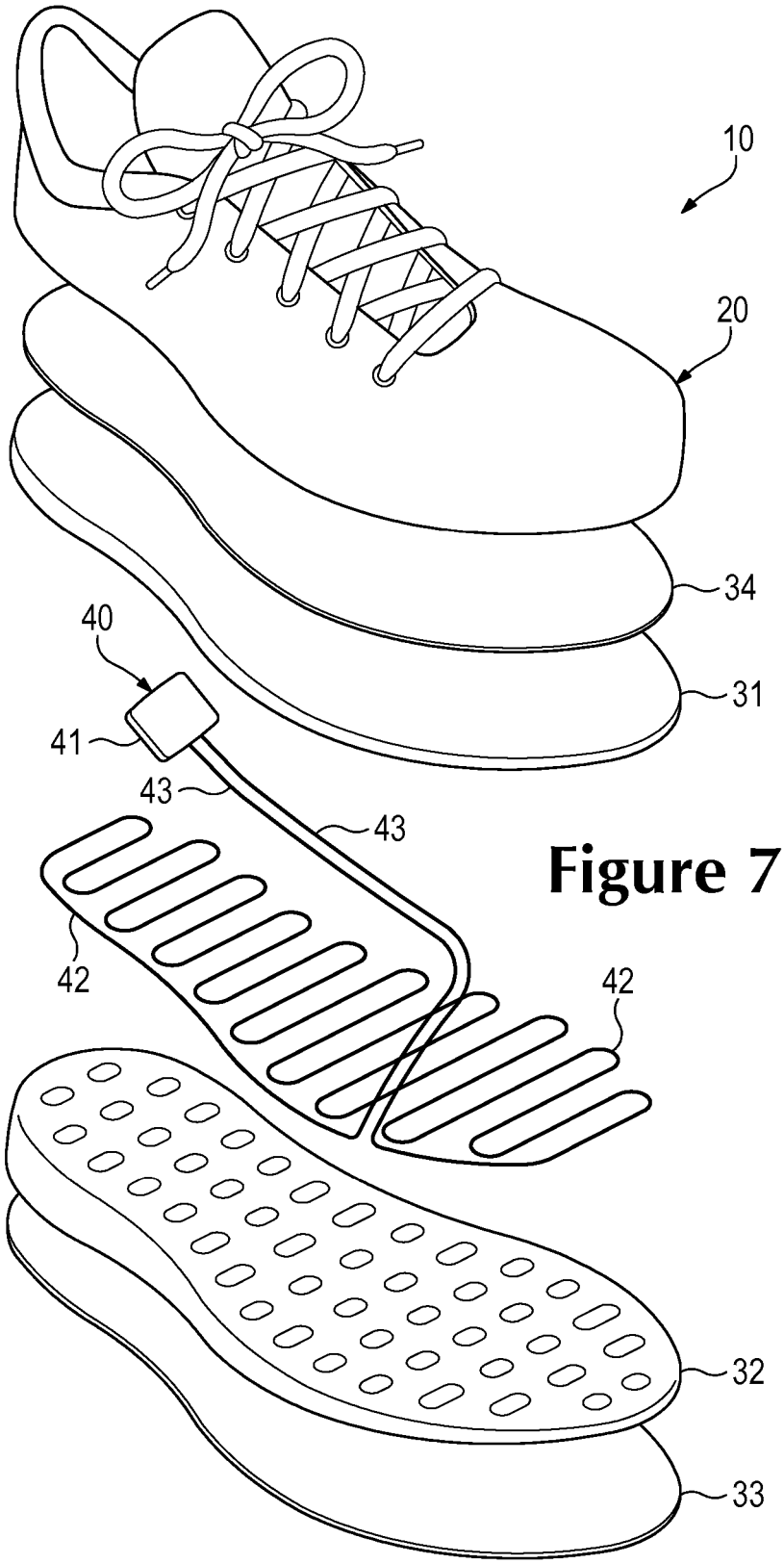
Figure 7C:
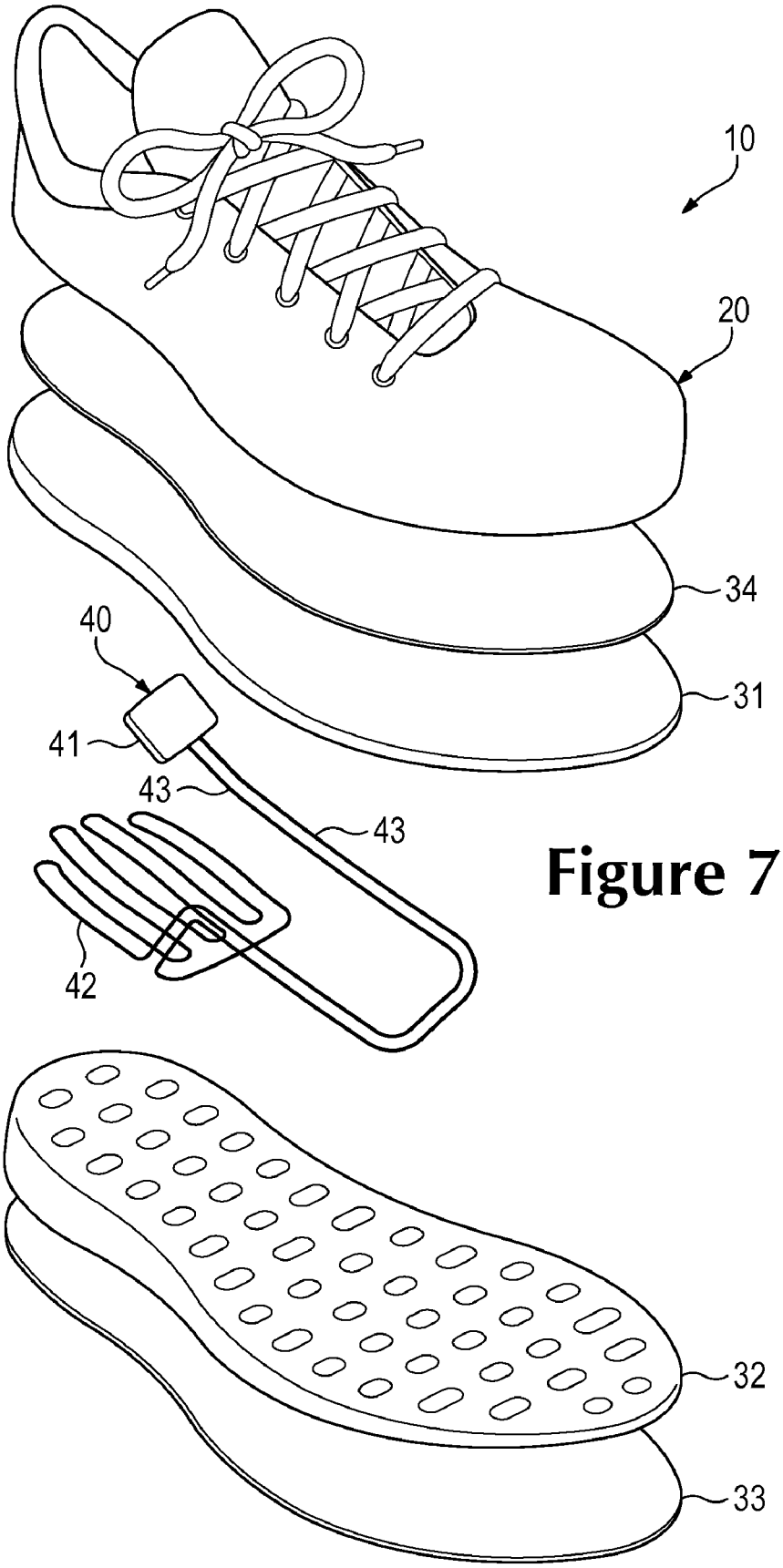
Figure 7D:
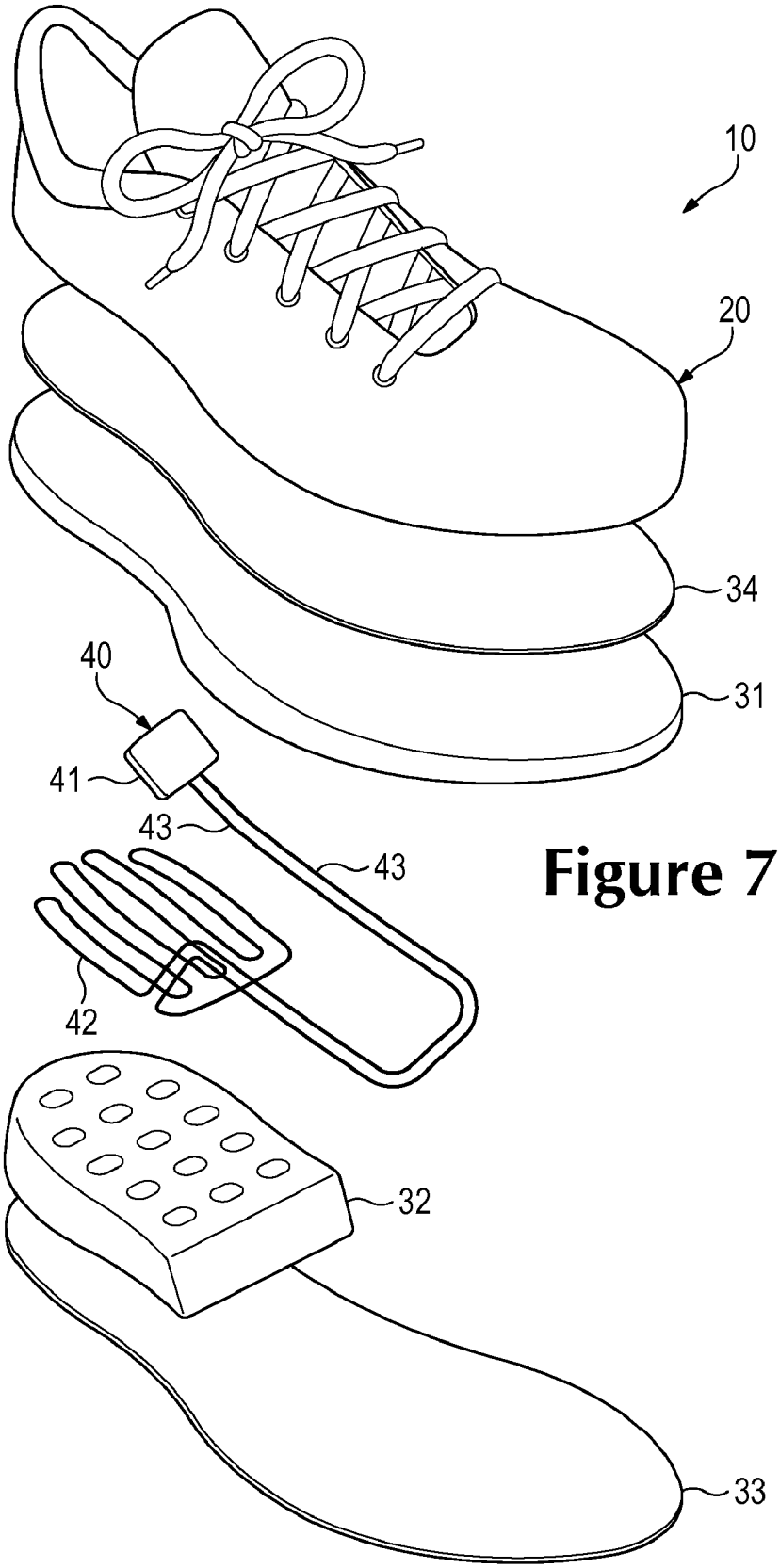

The overall configuration of footwear 10 discussed above is intended to provide an example of a suitable configuration for imparting an illuminable aspect to chamber 32. In other configurations of footwear 10, various aspects of upper 20, sole structure 30, and illumination circuit 40 may vary considerably. As discussed above, illuminable element 42 is positioned between midsole element 31 and chamber 32, located adjacent to the upper surface of chamber 32, and extends through each of regions 11-13 and between sides 14 and 15. Referring to FIG. 2, illuminable element 42 repeatedly extends from forefoot region 11 to heel region 13, thereby extending repeatedly along the longitudinal length of footwear 10. In other configurations, the manner in which illuminable element 42 is located in sole structure 30 may vary significantly. As depicted in FIG. 7A, for example, illuminable element 42 is located around the periphery of chamber 32, but remains embedded within sole structure 30 between midsole element 31 and chamber 32. In another configuration, which is depicted in FIG. 7B, illuminable element 42 repeatedly-crosses from lateral side 14 to medial side 15 of sole structure 30. FIG. 7C depicts a configuration wherein illuminable element 42 is primarily located in heel region 13, although chamber 32 extends through each of regions 11-13. Similarly, FIG. 7D depicts a configuration wherein both chamber 32 and illuminable element 42 are primarily located in heel region 13, and midsole element 31 extends between upper 20 and outsole 33 in regions 11 and 12. Accordingly, a variety of configurations may be utilized for the arrangement of illuminable element 42.

Figure 7E:
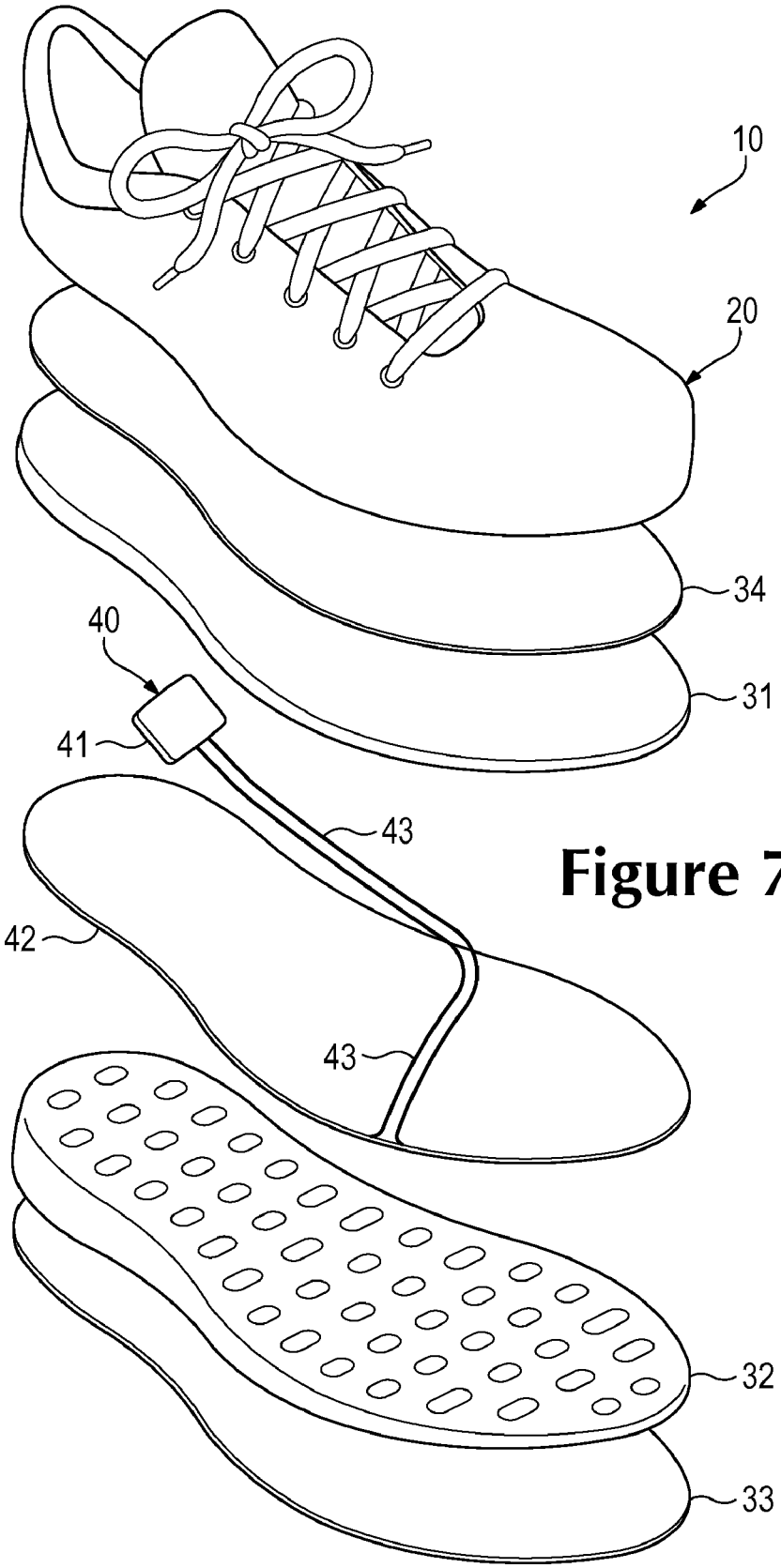
Figure 7F:
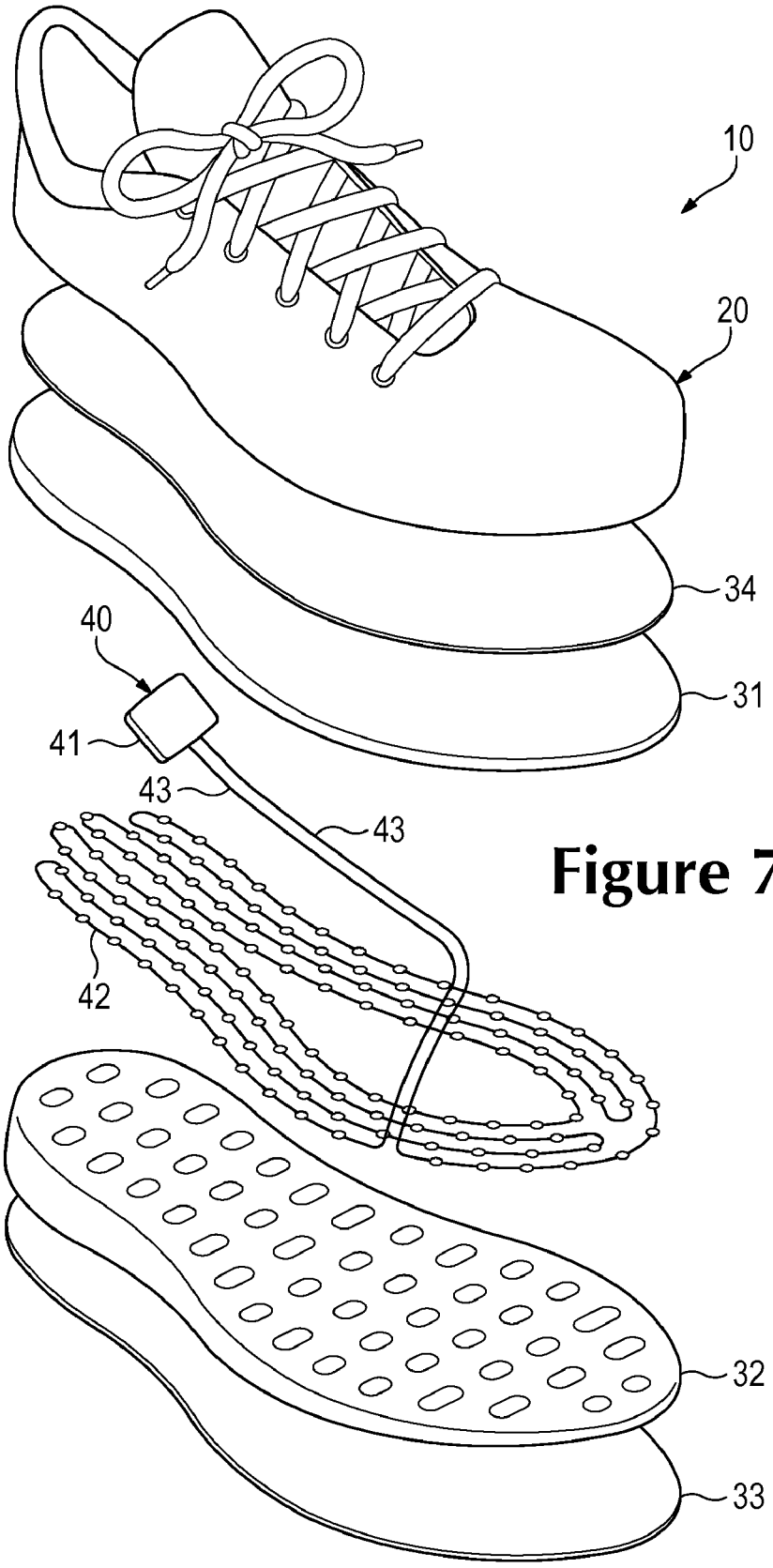

The use of electroluminescent wire for illuminable element 42 provides a variety of advantages to footwear 10. For example, electroluminescent wire generates minimal or no heat within sole structure 30 and also may be utilized to emit a variety of light colors. A variety of other light-emitting structures may, however, be utilized for illuminable element 42. Referring to FIG. 7E, illuminable element 42 is depicted as having the configuration of an electroluminescent panel having the general shape of chamber 32. Alternately, illuminable element 42 may be a series of light emitting diodes, as depicted in FIG. 7F.

Figure 8A:
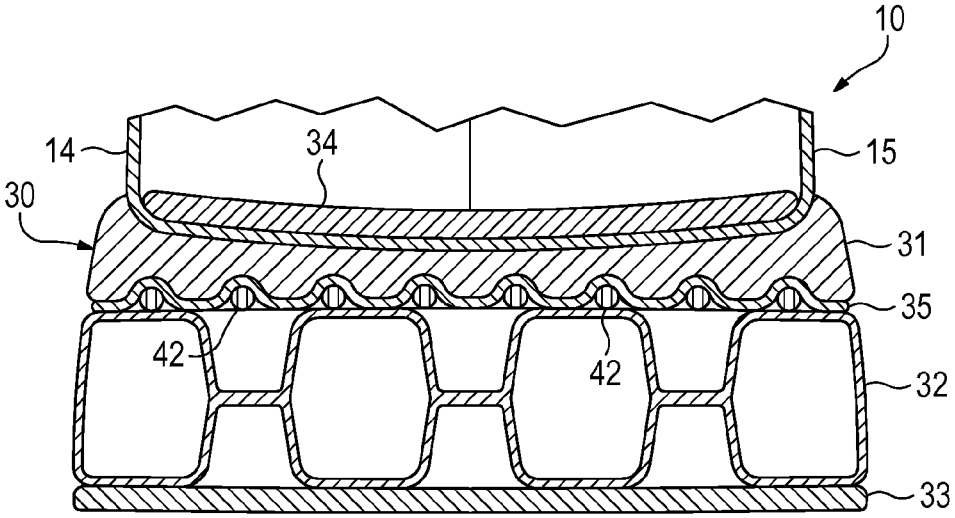
FIGS. 8A-8F are cross-sectional views corresponding with FIG. 5A and depicting further configurations of the article of footwear.
Figure 8B:
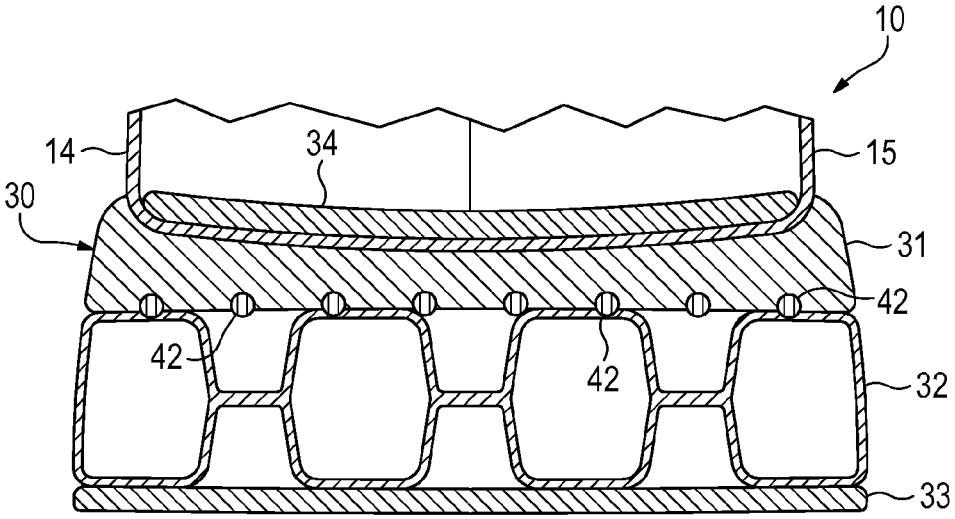
Figure 8C:
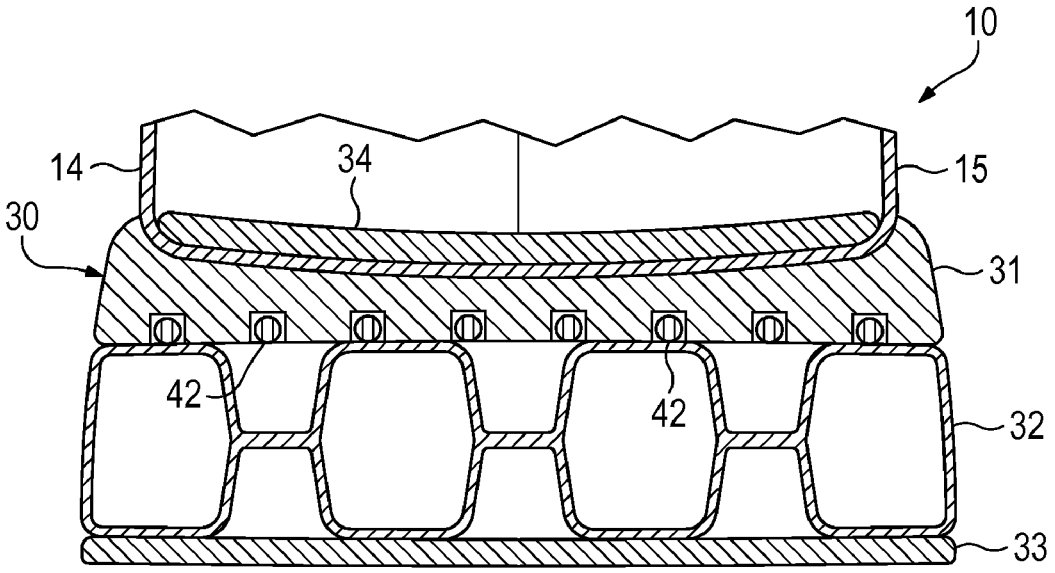
Figure 8D:
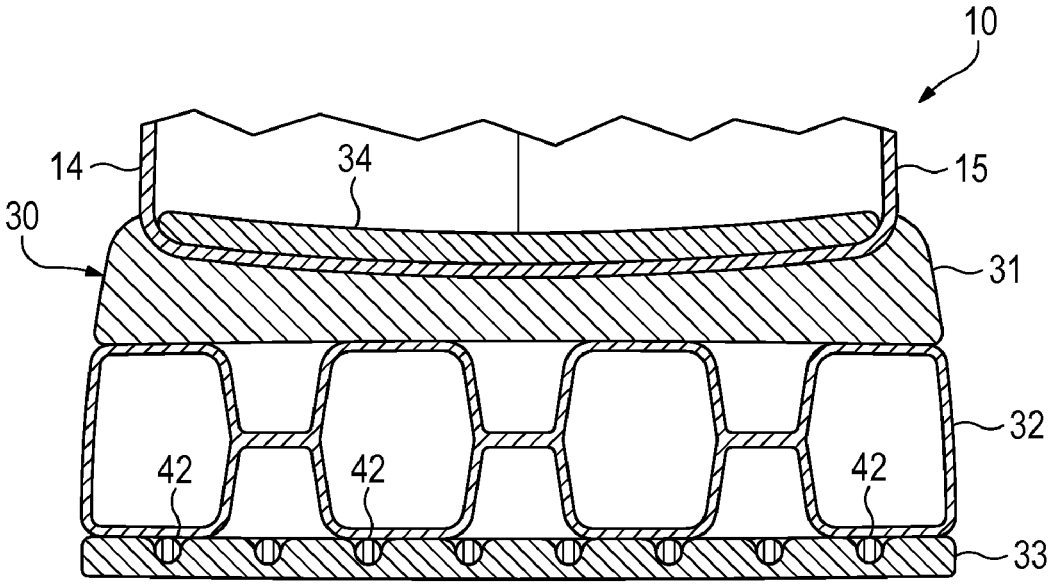
Figure 8E:
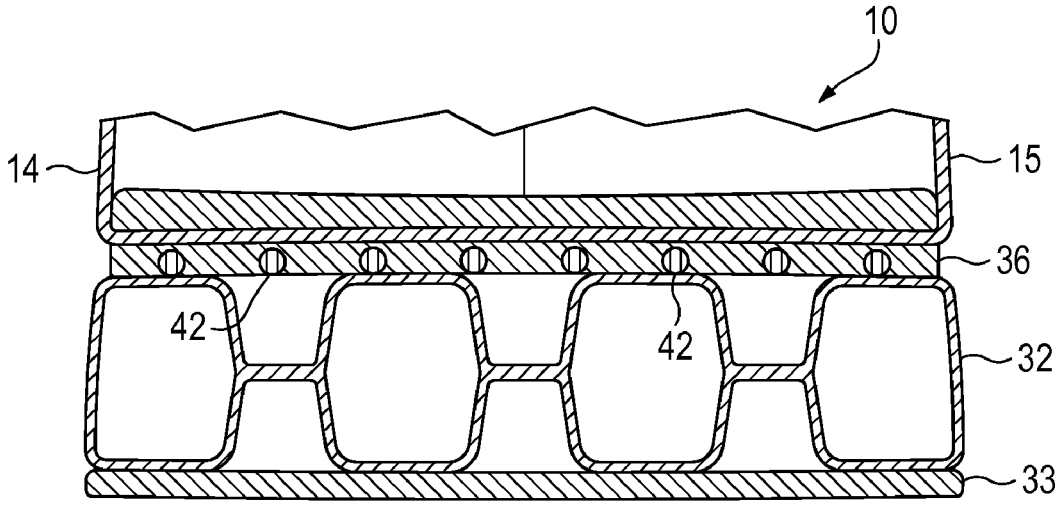
Figure 8F:
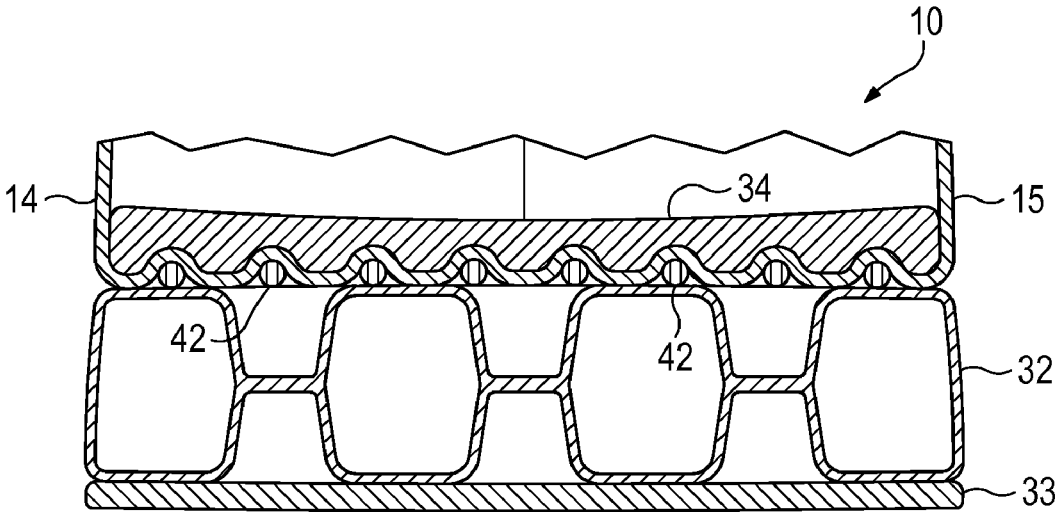

Illuminable element 42 has been discussed as embedded within sole structure 30 and between midsole element 31 and the exterior surface (i.e., upper surface) of chamber 32. A variety of other ways of incorporating illuminable element 42 into sole structure 30 may be utilized. Referring to FIG. 8A, for example, a polymer sheet 35 extends between and is secured to both midsole element 31 and chamber 32, and illuminable element 42 is positioned between polymer sheet 35 and the exterior surface of chamber 32. In another configuration, illuminable element 42 is embedded within the polymer material forming chamber 32, as depicted in FIG. 8B. Although midsole element 31 may be molded to partially encapsulate illuminable element 42, FIG. 8C depicts a configuration wherein midsole element 31 may incorporate preformed indentations in which illuminable element 42 is located. In each of the configurations of footwear 10 discussed above, illuminable element 42 is located above chamber 32. Referring to FIG. 8D, however, illuminable element 42 is positioned between chamber 32 and outsole 33. Illuminable element 42 may also be embedded within a plate 36, which may be formed of a more rigid material than polymer foam, as depicted in FIG. 8E. Additionally, midsole element 31 may be absent, as depicted in FIG. 8F, such that illuminable element 42 is positioned between upper 20 and chamber 32. Accordingly, the overall configuration of sole structure 30 and the manner in which illuminable element 42 is incorporated into sole structure 30 may vary significantly.

Various reflecting materials may be incorporated into sole structure 30 to enhance the perceived intensity of light emitted from illuminable element 42. As discussed above, the light emitted from illuminable element 42 may reflect off of the lower surface of chamber 32. In order to increase the reflectivity of the lower surface of chamber 32, metallic or other reflective materials may be incorporated into the lower surface of chamber 32. For example, a reflective foil may be located within chamber 32 or may extend between chamber 32 and outsole 33, or flakes of reflective material may be incorporated into the polymer material forming the lower surface of chamber 32. A reflective material may also be positioned above illuminable elements 42 to direct light into chamber 32.

The frequency of the alternating electric field has an effect upon the wavelength of the light emitted from the phosphor coating of electroluminescent wire, as discussed above. In order to permit the wearer to modify the color of the light passing out of chamber 32, power source 41 (e.g., an inverter within power source 41) may have a dial or other adjustment mechanism that permits the wearer to modify the frequency, thereby changing the color of the light passing out of chamber 32. Also as discussed above, coloring in the polymer sheath of electroluminescent wire imparts specific colors to the light that is emitted from illuminable element 42 and passes through chamber 32. Rather than coloring the polymer sheath, the polymer material of chamber 32 may incorporate dyes that determine the resulting color of the light passing out of chamber 32.

Figure 9:
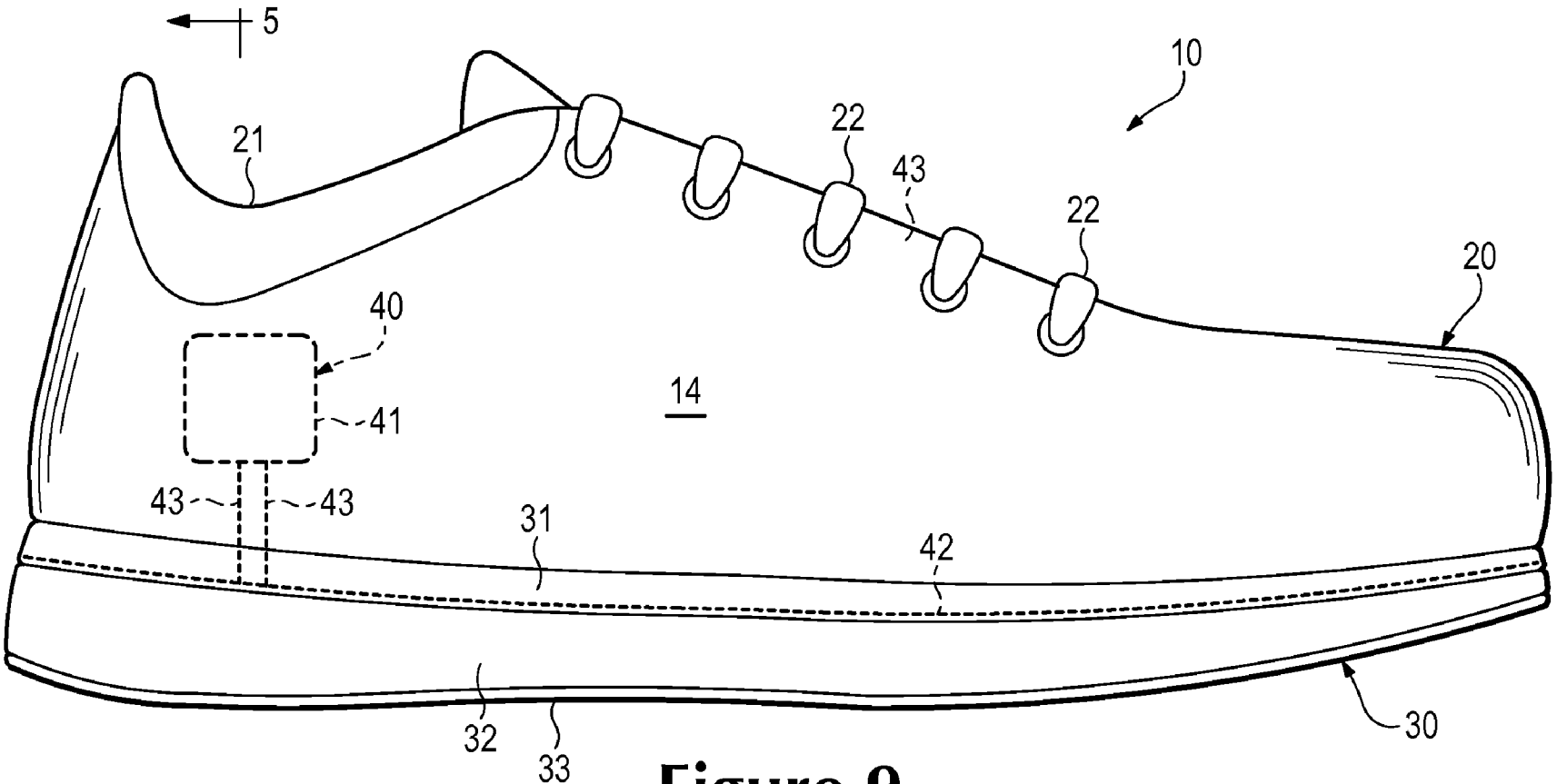
FIG. 9 is a lateral side elevational view corresponding with FIG. 3 and depicting a further configuration of the article of footwear.

Power source 41 is depicted in FIGS. 1-4 as being incorporated into tongue 23. The specific location of power source 41 may, however, vary depending upon the desired aesthetics, comfort, or other properties of footwear 10. As an example, power source 41 is depicted as being located in heel region 13 and on lateral side 14 in FIG. 9. In other configurations, however, power source 41 may be located in any of regions 11-13 and also on medial side 15. When a separate battery and inverter are utilized for power source 41, the battery and inverter may also be located in different regions or sides of footwear 10. Moreover, power source 41 may also be embedded within sole structure 30 in some configurations of footwear 10.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear having an upper and a sole structure secured to the upper, the sole structure comprising:

a chamber formed from an at least partially transparent polymer material that encloses a fluid, a portion of an exterior surface of the chamber being exposed to form a portion of an exterior surface of the footwear; and at least one illuminable element located within the sole structure and adjacent to the exterior surface the chamber;

wherein the illuminable element is located along an uppermost surface of the chamber.

2. The article of footwear recited in claim 1, wherein the illuminable element is an electroluminescent wire.

3. The article of footwear recited in claim 2, wherein the electroluminescent wire is located adjacent to a periphery of the sole structure.

4. The article of footwear recited in claim 2, wherein the electroluminescent wire repeatedly-crosses from a lateral side to a medial side of the sole structure.

5. The article of footwear recited in claim 1, wherein the illuminable element is one of an electroluminescent sheet and a light emitting diode.

6. The article of footwear recited in claim 1, wherein the illuminable element is positioned between the upper and the chamber.

7. The article of footwear recited in claim 1, wherein the sole structure further includes a polymer foam element located between the upper and the chamber, and the illuminable element is positioned between the polymer foam element and the chamber.

8. The article of footwear recited in claim 1, wherein the chamber and the illuminable element extend from a forefoot region to a heel region of the footwear, and the chamber forms the portion of the exterior surface of the footwear from the forefoot region to the heel region on both a lateral side and a medial side of the sole structure.

9. The article of footwear recited in claim 1, wherein the footwear further includes a power source electrically-coupled to the illuminable element.

10. An article of footwear having an upper and a sole structure secured to the upper, the sole structure comprising:

a chamber formed from an at least partially transparent polymer material that encloses a fluid, the chamber extending from a forefoot region to a heel region of the footwear, and the chamber extending from a medial side to a lateral side of the footwear, the chamber having:

(a) an upper surface oriented to face the upper, (b) a lower surface positioned opposite the upper surface and oriented to face a ground-engaging surface of the sole structure, and (c) a peripheral surface extending between the upper surface and the lower surface, at least a portion of the peripheral surface being exposed to an exterior of the footwear from the forefoot region to the heel region on both the medial side and the lateral side; and at least one illuminable element embedded within the sole structure and in contact with the upper surface of the chamber, the illuminable element extending from the forefoot region to the heel region.

11. The article of footwear recited in claim 10, wherein the illuminable element is one of an electroluminescent wire, an electroluminescent panel, and a light emitting diode.

12. The article of footwear recited in claim 10, wherein the sole structure further includes a polymer foam element located between the upper and the chamber, and the illuminable element is positioned between the polymer foam element and the upper surface of the chamber.

13. The article of footwear recited in claim 10, wherein the footwear further includes a power source electrically-coupled to the illuminable element.

14. An article of footwear having an upper and a sole structure secured to the upper, the sole structure comprising:

a fluid-filled chamber formed from an at least partially transparent polymer material, the chamber having an exterior surface, a first area of the exterior surface being exposed to an exterior of the footwear, and a second area of the exterior surface being located within the sole structure;

an opaque material secured to a portion of the second area of the exterior surface; and at least one illuminable element located between the opaque material and the second area of the exterior surface;

wherein light from the illuminable element is capable of passing (a) into the chamber through the first area of the exterior surface and (b) out of the chamber through the second area of the exterior surface; and wherein the illuminable element has a continuous, planar arrangement.

15. The article of footwear recited in claim 14, wherein the illuminable element is one of an electroluminescent wire, an electroluminescent sheet, and a light emitting diode.

16. The article of footwear recited in claim 14, wherein the opaque material is a polymer foam element that extends between the upper and the chamber, and the illuminable element is positioned between the polymer foam element and the chamber.

17. The article of footwear recited in claim 14, wherein the chamber and the illuminable element extend from a forefoot region to a heel region of the footwear.

18. The article of footwear recited in claim 17, wherein the first area of the exterior surface is exposed from the forefoot region to the heel region.

19. The article of footwear recited in claim 17, wherein the first area of the exterior surface is positioned on a lateral side and a medial side of the footwear.

20. The article of footwear recited in claim 14, wherein the footwear further includes a power source electrically-coupled to the illuminable element.

* * * * *